US009462887B2

(12) United States Patent
Harwood et al.

(10) Patent No.: US 9,462,887 B2
(45) Date of Patent: Oct. 11, 2016

(54) FURNITURE MEMBER SEATBACK LINKAGE WITH CAM MEMBER FOR ADJUSTING SEATBACK ANGLE

(71) Applicant: La-Z-Boy Incorporated, Monroe, MI (US)

(72) Inventors: Eric B. Harwood, Toledo, OH (US); Larry P. Lapointe, Temperance, MI (US); Richard D. Hartford, Maybee, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 238 days.

(21) Appl. No.: 14/298,124

(22) Filed: Jun. 6, 2014

(65) Prior Publication Data

US 2015/0351545 A1 Dec. 10, 2015

(51) Int. Cl.

| | |
|---|---|
| ***B60N 2/20*** | (2006.01) |
| ***B60N 2/22*** | (2006.01) |
| ***A47C 1/024*** | (2006.01) |

(52) U.S. Cl.

CPC ..... *A47C 1/024* (2013.01)

(58) Field of Classification Search

CPC ..... A47C 1/024; B60N 2/22
USPC ..... 297/361.1
See application file for complete search history.

(56) References Cited

U.S. PATENT DOCUMENTS

| | | | | | |
|---|---|---|---|---|---|
| 4,063,776 | A * | 12/1977 | Wahlmann | B60N 2/2252 | 297/361.1 |
| 4,200,333 | A * | 4/1980 | Cremer | B60N 2/0232 | 297/362 X |
| 4,384,744 | A * | 5/1983 | Barley | B60N 2/2356 | 297/367 R X |
| 4,598,947 | A * | 7/1986 | Fourrey | B60N 2/2252 | 297/354.12 |
| 4,865,386 | A * | 9/1989 | Detloff | B60N 2/23 | 188/82.3 |
| 5,265,936 | A * | 11/1993 | Droulon | B60N 2/22 | 297/361.1 X |
| 5,280,999 | A * | 1/1994 | Jones | B60N 2/2352 | 297/354.12 |
| 5,295,730 | A * | 3/1994 | Rees | B60N 2/2231 | 297/354.12 |
| 5,338,093 | A * | 8/1994 | Ikegaya | B60N 2/2352 | 297/354.1 |
| 5,382,076 | A * | 1/1995 | Scheck | F16H 31/002 | 297/354.12 |
| 5,984,412 | A * | 11/1999 | Magyar | B60N 2/23 | 297/362.12 |
| 6,173,921 | B1 * | 1/2001 | Neumann | B64D 11/06 | 244/118.6 |
| 6,209,955 | B1 * | 4/2001 | Seibold | B60N 2/2352 | 297/216.13 |
| 6,474,741 | B2 * | 11/2002 | Kamida | B60N 2/0292 | 297/335 |

(Continued)

OTHER PUBLICATIONS

Robotic Mechanisms—Cam Mechanisms 51050, Jul. 21, 2013, http://www.robotpark.com/academy/robotic-mechanisms-cam-mechanisms-51050/.*

*Primary Examiner* — Rodney B White
*Assistant Examiner* — Jody Giacoman
(74) *Attorney, Agent, or Firm* — Harness, Dickey & Pierce, P.L.C.

(57) ABSTRACT

A seatback member cam adjustment system includes a seat link having a first bore and a seatback link rotatably connected to the seat link. The seatback link includes an arm portion and a leg portion connected to the arm portion. The leg portion is angularly oriented to the arm portion, and includes a second bore smaller than the first bore. A cam member cam body is positioned in the first bore. A cam body obround cam surface has oppositely facing first and second cam contact points both in direct contact with a first bore inner wall. A cam mount shaft is rotatably supported in the cam member including and extends through the second bore rotatably supporting the cam mount shaft in the second bore. Cam member rotation displaces the cam contact points along the first bore inner wall changing an arm portion orientation angle and a seatback member orientation angle.

20 Claims, 9 Drawing Sheets

(56) References Cited

U.S. PATENT DOCUMENTS

2003/0085603 A1* 5/2003 Lee ..... B60N 2/2356
297/367 R

2014/0125096 A1* 5/2014 Barzen ..... B60N 2/2356
297/216.13

2014/0292054 A1* 10/2014 Pluta ..... B60N 2/22
297/354.1

* cited by examiner

FURNITURE MEMBER SEATBACK LINKAGE WITH CAM MEMBER FOR ADJUSTING SEATBACK ANGLE

FIELD

The present disclosure relates to furniture members having multiple rotatable seatbacks and linkage systems to control individual seatback positioning.

BACKGROUND

This section provides background information related to the present disclosure and is not necessarily prior art.

Conventionally, reclining articles of furniture (i.e., sofas, loveseats, and the like), referred to hereinafter generally as reclining furniture members, utilize one or more mechanisms to bias a leg rest assembly between retracted and extended positions and separate components to allow a seatback member to rotate between an upright and a fully reclined position with respect to a seat base.

In reclining furniture members having multiple sections each adapted to support a separate occupant, each section can include its own seatback member, and each seatback member can be either of a fixed position design or a rotatable design. Due to construction tolerances and the quantity of stack-up dimensions required to operate the multiple linkages of a common reclining furniture member seatback member, the actual position of each seatback member at a nominal or upright position can vary by up to approximately 4 degrees from one or more of the other seatback members. This misalignment between seatback members can be visually noticeable to the furniture member owner and/or occupant.

SUMMARY

This section provides a general summary of the disclosure, and is not a comprehensive disclosure of its full scope or all of its features.

According to several aspects, a seatback member cam adjustment system includes a seat link having a first bore and a seatback link rotatably connected using a rotational fastener to the seat link. The seatback link includes: an arm portion; and a leg portion integrally connected to the arm portion. The leg portion is oriented at an angle with respect to the arm portion, and includes a second bore smaller than the first bore. A cam member has a cam body positioned in the first bore of the seat link. An obround cam surface of the cam body has oppositely facing first and second cam contact points both in direct contact with a bore inner wall of the first bore. A cam mount shaft is rotatably supported in the cam member including in the cam body and extends through the second bore of the seatback link such that the cam mount shaft is rotatably supported in the second bore. Rotation of the cam member displaces the first and second cam contact points along the bore inner wall of the first bore thereby changing an orientation angle of the arm portion with respect to the seat link and changing an orientation angle of a furniture member seatback member.

According to other aspects, a seatback member cam adjustment system includes a seat link having a first bore. A seatback link is rotatably connected using a rotational fastener to the seat link. The seatback link has a leg portion, the leg portion including a second bore smaller than the first bore. A cam member has a cam body positioned in the first bore of the seat link. An oval shaped cam surface of the cam body has oppositely facing first and second cam contact points both in direct contact with a bore inner wall of the first bore and a portion of the cam surface between the first and second cam contact points spaced away from the bore inner wall. A cam mount shaft is rotatable about a longitudinal axis of the cam mount shaft in the cam body and extends through the second bore of the seatback link such that the cam member is rotatably supported by the cam mount shaft. Rotation of the cam member repositions the first and second contact points along the bore inner wall of the first bore thereby changing an orientation angle of the seatback link with respect to the seat link.

According to further aspects, a seatback member cam adjustment system includes a seat link having a first bore. A seatback link is rotatably connected using a rotational fastener to the seat link. The seatback link includes an arm portion and a leg portion integrally connected to the arm portion. The leg portion is oriented at an angle with respect to the arm portion and includes a second bore smaller than the first bore. A coupling member is fixed to a seatback member. The arm portion of the seatback link is coupled to the coupling member. The leg portion of the seatback member is connected by the rotational fastener to the seat link and further to an arcuate link. A cam member has a cam body positioned in the first bore of the seat link. An obround cam surface of the cam body has oppositely facing first and second cam contact points both in direct contact with a bore inner wall of the second bore. A cam mount shaft rotatably supported in the cam body extends through the second bore of the seatback link such that the cam mount shaft is rotatably supported in the second bore. Rotation of the cam member changes an orientation angle of the arm portion with respect to the seat link and thereby adjusts an orientation angle of a furniture member first seatback member connected to the arm portion of the seatback link.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
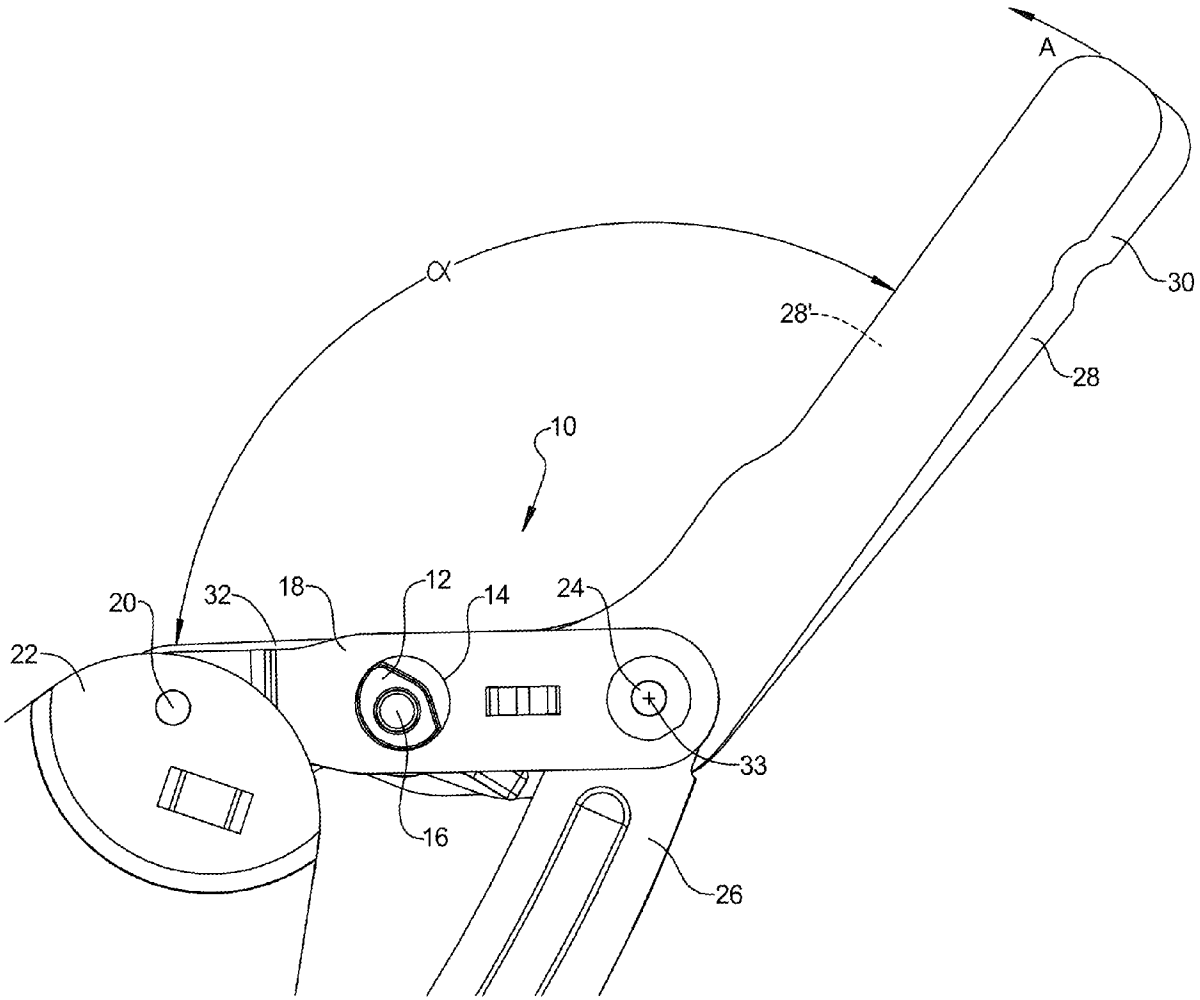
FIG. 1 is a side elevational view of a furniture member seatback linkage with a cam member for adjusting a seatback angle.

Referring to FIG. 1, a seatback member cam adjustment system 10 includes a cam member 12 which is rotatably positioned in a first bore 14 and rotates with respect to a cam mount shaft 16. The bore 14 is created in a seat link 18 which is rotatably connected at a first end using a first rotational fastener 20 to a link mounting plate 22. The seat link 18 is also rotatably connected at a second end, using a second rotational fastener 24 to an arcuate link 26. Arcuate link 26 is also connected at an end (not shown) to the link mounting plate 22. The arcuate link 26 allows rotation of a seatback member of a furniture member, which will be described in greater detail in reference to FIG. 2. A seatback link 28 is also rotatably connected using the second rotational fastener 24 to both the seat link 18 and to the arcuate link 26. The seatback link 28 includes an arm 30 integrally connected to a leg 32. The arm 30 is oriented at a fixed angle $\alpha$ greater than 90 degrees with respect to leg 32. The second rotational fastener 24 extends through seatback link 28 approximately at a junction between the arm 30 and leg 32.

The cam member 12 is rotatably connected to the seatback link 28 such that when the cam member 12 is manually rotated within the bore 14 of the seat link 18, the seatback link 28 is rotatably displaced in a link adjustment direction "A" from the first position shown as seatback link 28 to a second position shown as seatback link 28', and/or oppositely rotated back to the original position of seatback link 28. According to several aspects, rotation of cam member 12 provides approximately 4 degrees of rotation for the seatback link 28 to allow for adjustment of seatback link 28. The seatback link 28 rotates with respect to second rotational fastener 24 about an axis of rotation 33 of second rotational fastener 24 which also defines one rotational axis for rotation of seat link 18 and arcuate link 26. The first rotational fastener 20 does not extend through or contact leg 32.

Referring to FIG. 2 and again to FIG. 1, a furniture member 34, which is shown for example as a multi-sectional couch or sofa, provides an exemplary embodiment for installation of multiple ones of the seatback member cam adjustment system 10. It is noted that furniture member 34 can also be any other type of furniture member including a reclining chair, a gliding chair, or loveseat. In the embodiment shown for furniture member 34, first, second, and third furniture member frame sections 35, 36, 38 are provided for each of three occupants of the furniture member 34. A mechanism 40 can be provided with any one of or each of the first, second, and/or third furniture member frame sections 35, 36, 38. Each mechanism 40 provides for powered operation of various components supported by each of the frame sections. End members of the furniture member 34 can also include an arm rest, such as a left-hand arm rest 42 shown. Arm rest 42 is connected to and supports first furniture member frame section 35. It will be understood that mechanism 40 could also be a manual (i.e., non-powered) mechanism.

Independent operation of each mechanism 40 provides for rotation of individual ones of a first, second, and third seatback member 44, 46, 48, each individually and rotatably connected to one of the first, second, or third furniture member frame sections 35, 36, 38. Each of the seatback members 44, 46, 48 includes a first seatback frame member 50 and a mirror image second seatback frame member 52. In the embodiment shown, the seatback link 28 is slidingly received in a coupling member 53 connected to first seatback frame member 50, while another seatback link 28 is similarly coupled using a second coupling member (not visible in this view) similarly connected to second seatback frame member 52. In any of the first, second, and/or third furniture member frame sections 35, 36, 38 not having a mechanism 40, such as second furniture member frame section 36 shown, the corresponding seatback member (seatback member 46) can still be provided with seatback member cam adjustment systems 10 to permit adjustment of seatback member 46 with respect to the other seatback members.

The individual positions of the first, second, and third seatback members 44, 46, 48 can vary with respect to each other based on construction and stack-up tolerances such that a seatback rear edge 56 of first seatback member 44 can be misaligned with respect to a seatback rear edge 58 of second seatback member 46 and/or with respect to a seatback rear edge 60 of third seatback member 48. For visual aesthetics, it is desirable that each of the seatback rear edges 56, 58, 60 align with respect to a common reference line 62 at the seatback upright positions shown.

Two seatback member cam adjustment systems 10 are provided with each of the first, second, and third furniture member frame sections 35, 36, 38, and allow for individual adjustment of each of the seatback rear edges 56, 58, 60 to align the seatback rear edges 56, 58, 60 on reference line 62. This alignment can be performed at the factory during assembly of the furniture member 34, or also can be performed at the point of sale of furniture member 34. The common alignment of each of the seatback rear edges 56, 58, 60 is desirable to provide an aesthetically optimal condition for furniture member 34 at a nominal or upright operating position. Each pair of seatback member cam adjustment systems 10 can therefore provide for individual adjustment of the first, second, and/or third seatback member 44, 46, 48 to provide this alignment.

Additionally or alternatively, the adjustment systems 10 of one or more of the seatback members 44, 46, 48 can be adjusted to a position that provides most comfort for a particular user or owner of the furniture member 34. For example, some users may find the furniture member 34 most comfortable with one or more of seatback members 44, 46, 48 in the forward-most position, while other users may find the furniture member 34 most comfortable with one or more of seatback members 52, 54, 56 in the nominal position or in the rearward-most position. Therefore, the adjustment systems 10 can be advantageously incorporated into articles of furniture including one or more reclining mechanisms 40 (or any other reclining mechanism) as well as articles of furniture that do not include reclining mechanisms 40 (or any other reclining mechanism) or sections of an article of furniture that do not include a reclining mechanism 40 (or any other reclining mechanism).

Figure 2:
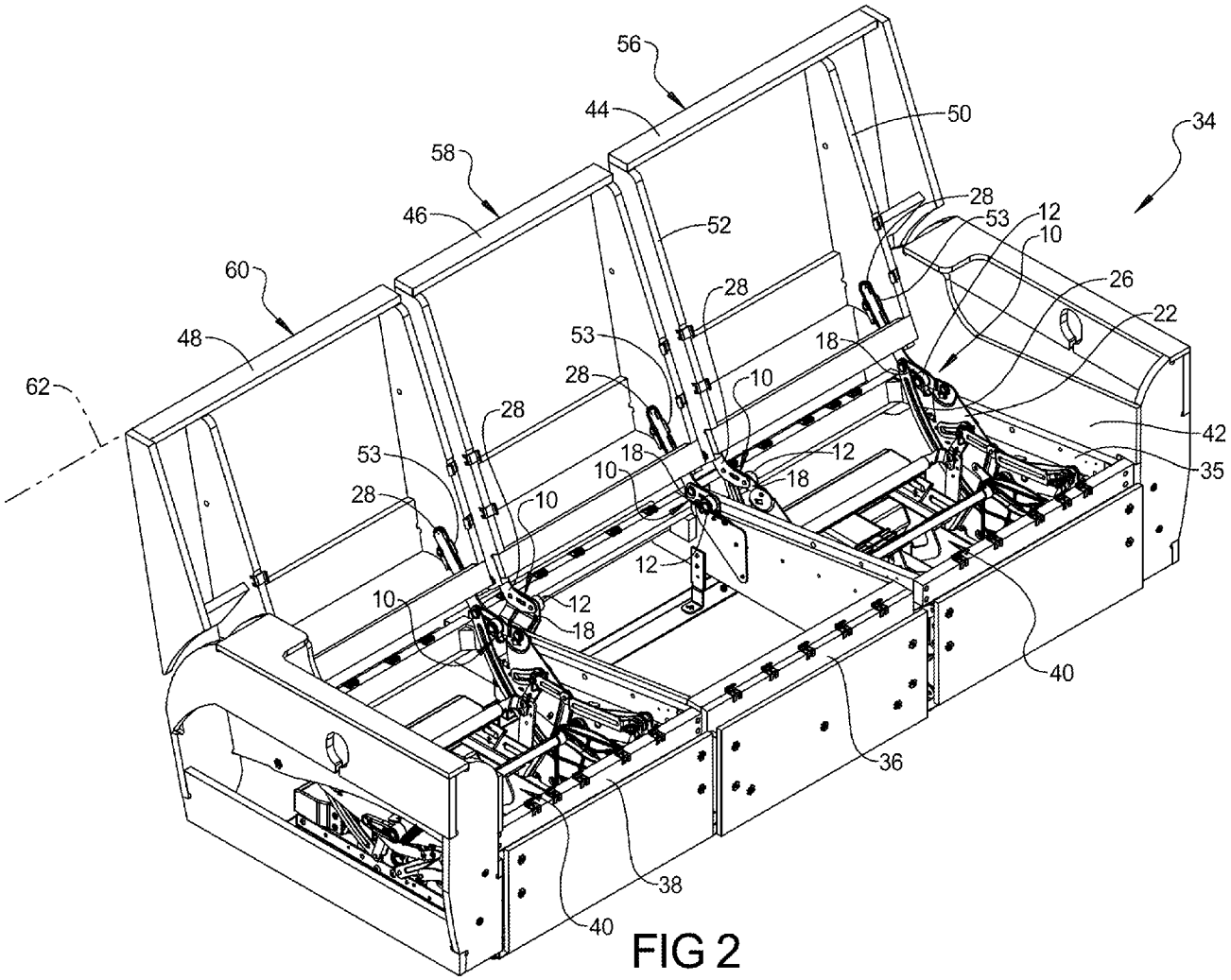
FIG. 2 is a front right perspective view of a multiple section furniture member having multiple seatback member cam adjustment systems of FIG. 1.

Referring to FIG. 3 and again to FIGS. 1-2, the first seatback member 44 is shown in a forward-most adjusted or rotated position reached by use of the two seatback member cam adjustment systems 10 of first seatback member 44, which working together provide seatback rotation in a seatback forward rotation direction "B". The first seatback member 44 has its seatback rear edge 56 rotated approximately 4 degrees forward of the seatback rear edges 58, 60 of the second and third seatback members 46, 48 by rotation of the seat links 28 with respect to the axis of rotation of the second rotational fasteners 24 of first seatback member 44. This represents a maximum adjusted rotated position permitted by the cam members 12 of seatback member cam adjustment systems 10.

It is noted that mechanism 40 is not operated to achieve the adjustment provided by seatback member cam adjustment systems 10. It is further noted that the arm rest 42 is connected only with respect to the first furniture member frame section 35 such that adjustment of the first seatback member 44, with respect to the seatback forward rotation direction "B", only involves the motion of the first seatback member 44. It should be apparent that the first seatback member 44, as well as the remaining second and third seatback members 46, 48, can be adjusted in either the seatback forward rotation direction "B" or oppositely rotated to achieve alignment with respect to reference line 62 by operation of the cam members 12 associated with each of the first, second, or third furniture member frame sections 35, 36, 38.

Figure 3:
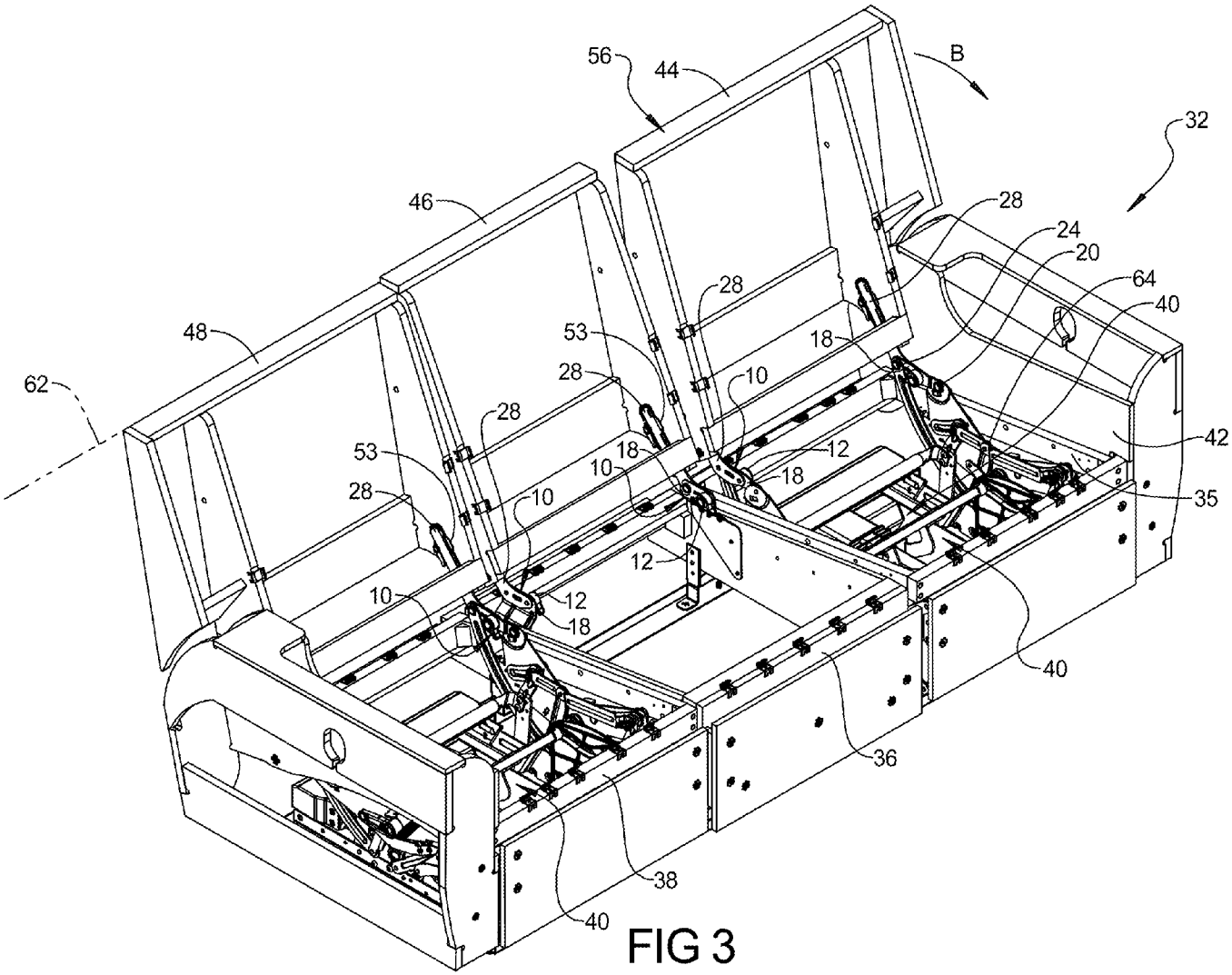
FIG. 3 is a front right perspective view of the furniture member of FIG. 2 having one of the seatback members adjusted to a furthest forward position.

Referring to FIG. 4 and again to FIGS. 1-3, an exemplary cam member 12, positioned in an exemplary bore 14, is presented in a first rotation position corresponding to the rearmost rotated position of the seatback member such as those referred to with respect to FIG. 2. Each cam member 12 is supported using the cam mount shaft 16, which is slidably and rotatably received in a bearing sleeve 66. The bearing sleeve 66 is itself positioned in a sleeve liner 68 integrally provided with the cam member 12. According to several aspects, cam member 12 is a polymeric material which is molded for example using an injection molding process to create the geometry of the cam member 12. According to several aspects, the cam mount shaft 16 is a metal, such as a steel or aluminum, providing the sheer strength necessary for support of the seatback members 44, 46, 48 in any of their rotated positions.

In each of the rotated positions of cam member 12, a shaft central longitudinal axis 70 of the cam mount shaft 16 is always displaced with respect to a bore center axis 72 of bore 14. It is this displacement between the shaft central longitudinal axis 70 and bore center axis 72 and subsequent rotation of the cam member 12 that allows for adjustment of the position of the individual seatback members. The cam mount shaft 16 extends transversely with respect to a first cam end face 74 such that a cam surface 76 is oriented substantially parallel with respect to the shaft central longitudinal axis 70. The cam surface 76, however, defines an obround or oval shape such that the cam surface 76 only provides a first cam contact point 78 and a second cam contact point 80 with respect to a bore inner wall 82 of the bore 14. The first and second cam contact points 78, 80 are always aligned with respect to the bore center axis 72. The obround or oval shape of the cam surface 76 therefore provides a first gap $G_1$ which reaches a maximum gap width approximately midway between first and second cam contact points 78, 80. There is a portion of the gap $G_1$ varying between a minimum value and the maximum gap width always present between the bore inner wall 82 and the cam surface 76 at all locations between the first and second cam contact points 78, 80.

An axis reference line 84, extending through shaft central longitudinal axis 70, is therefore displaced with respect to a reference line extending through each of the first and second cam contact points 78, 80. In addition to cam surface 76, an oppositely facing cam free wall 86 is freely positioned away from bore inner wall 82 at all locations, allowing for the free rotation of cam member 12. At the first position of cam member 12 (shown), the first cam contact point 78 contacts the bore inner wall 82 at a first cam contact position $Z_1$. Similarly, a second cam contact point 80 contacts the bore inner wall 82 at a second cam contact position $Z_2$. First and second cam contacts positions $Z_1$, $Z_2$ are positioned 180 degrees apart from each other.

Figure 4:
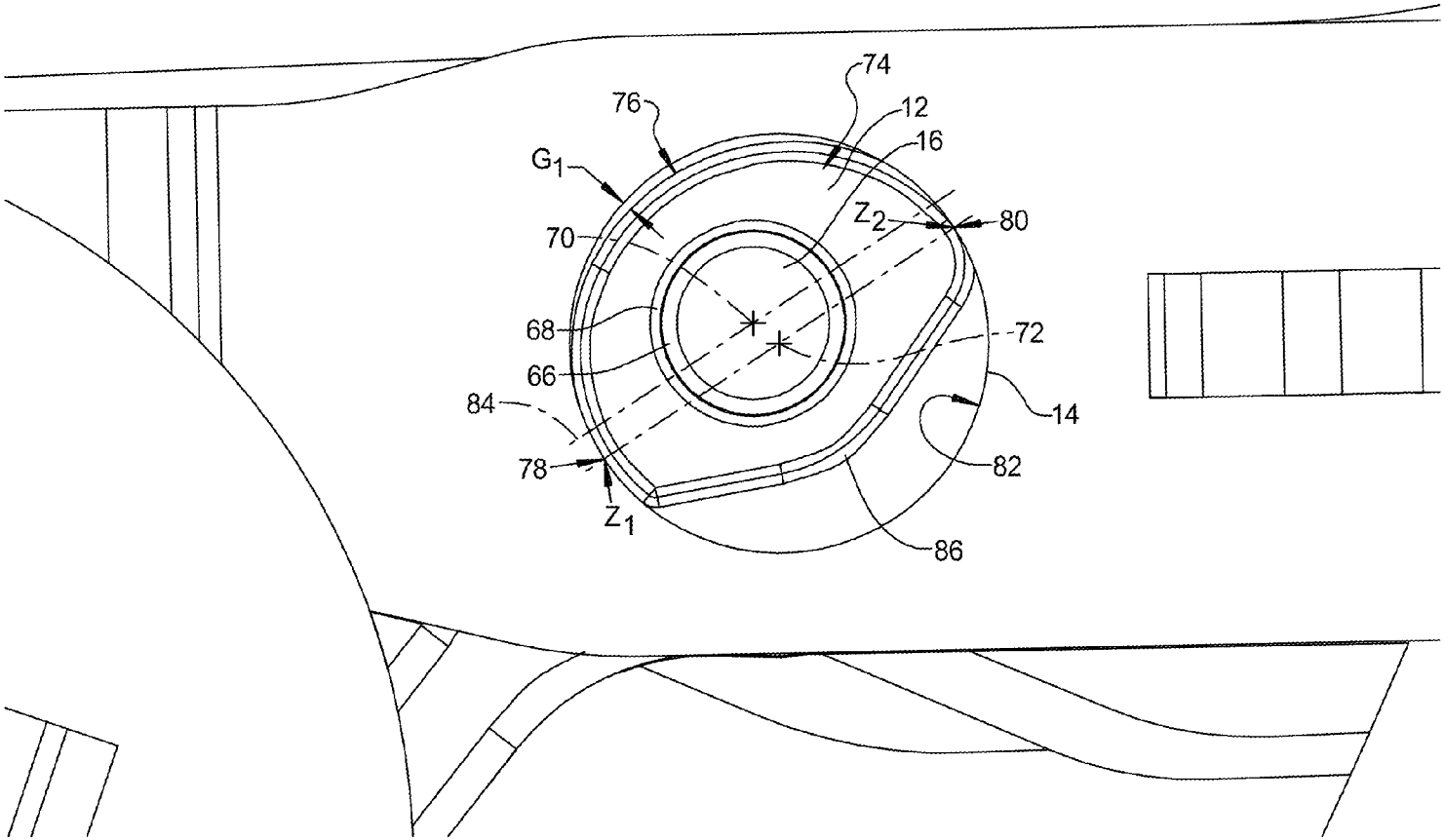
FIG. 4 is a side elevational view similar to FIG. 1 showing a cam member in a first adjustment position.
Figure 5:
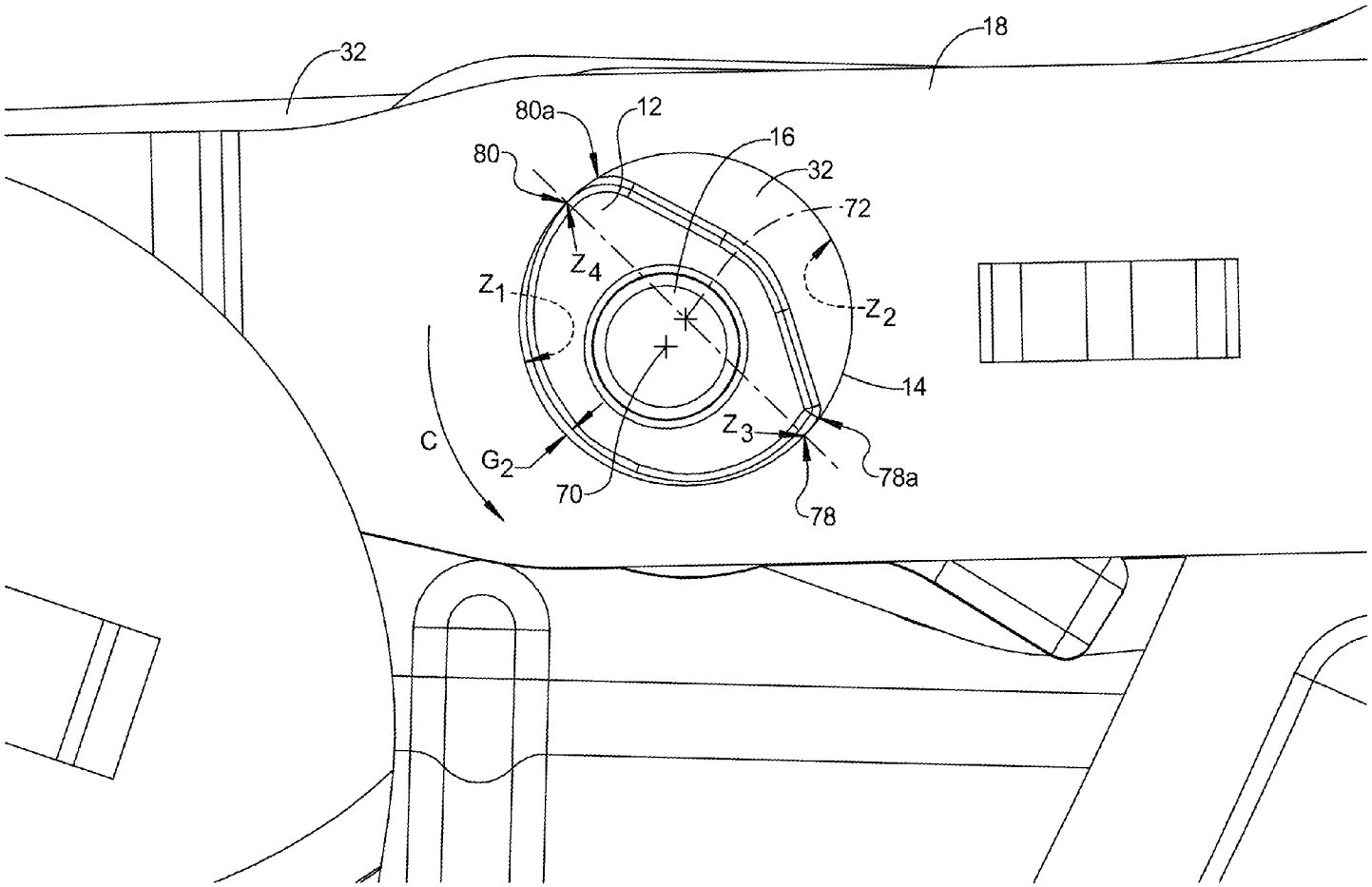
FIG. 5 is a side elevational view similar to FIGS. 1 and 4 showing the cam member in a second adjustment position.

Referring to FIG. 5 and again to FIG. 4, cam member 12 is shown after a counter-clockwise rotation with respect to a cam member arc of rotation "C" which positions cam member 12 in a fully adjusted position representing the forward rotated position of seatback link 28' (shown in reference to FIG. 1). At the second or rotated position of cam member 12, the first cam contact point 78 contacts a third cam contact position $Z_3$, and the second cam contact point 80 contacts a fourth cam contact position $Z_4$ of the bore inner wall 82. Like first and second cam contacts positions $Z_1$, $Z_2$, third and fourth cam contact positions $Z_3$ and $Z_4$ are also positioned 180 degrees apart from each other. For reference, each of the first and second cam contact positions $Z_1$, $Z_2$ are shown in phantom in FIG. 5 to indicate the amount of displacement between the various cam contact positions.

It is noted that at the second rotated position of cam member 12, a second gap $G_2$ is maximized midway between the third and fourth cam contact positions $Z_3$, $Z_4$. According to several aspects, the second gap $G_2$ is substantially equal to first gap $G_1$ due to the circularity of bore 14. Also at this rotated position of cam member 12, the shaft central longitudinal axis 70 is displaced downwardly and to the left compared to the relative position of shaft central longitudinal axis 70 as shown in FIG. 4, which represents the initial or pre-rotated position of cam member 12. An extended portion **78*a*, 80*a* of each of the first and second cam contact points 78, 80 are provided to prevent the cam member 12 from displacing with respect to the bore center axis 72 except for its axial rotation with respect to bore center axis 72. The first and second cam contact points 78, 80 are therefore extended by extended portions 78*a*, 80*a* to an opposite side of the reference line extending through bore center axis 72 with respect to cam surface 76**.

Figure 6:
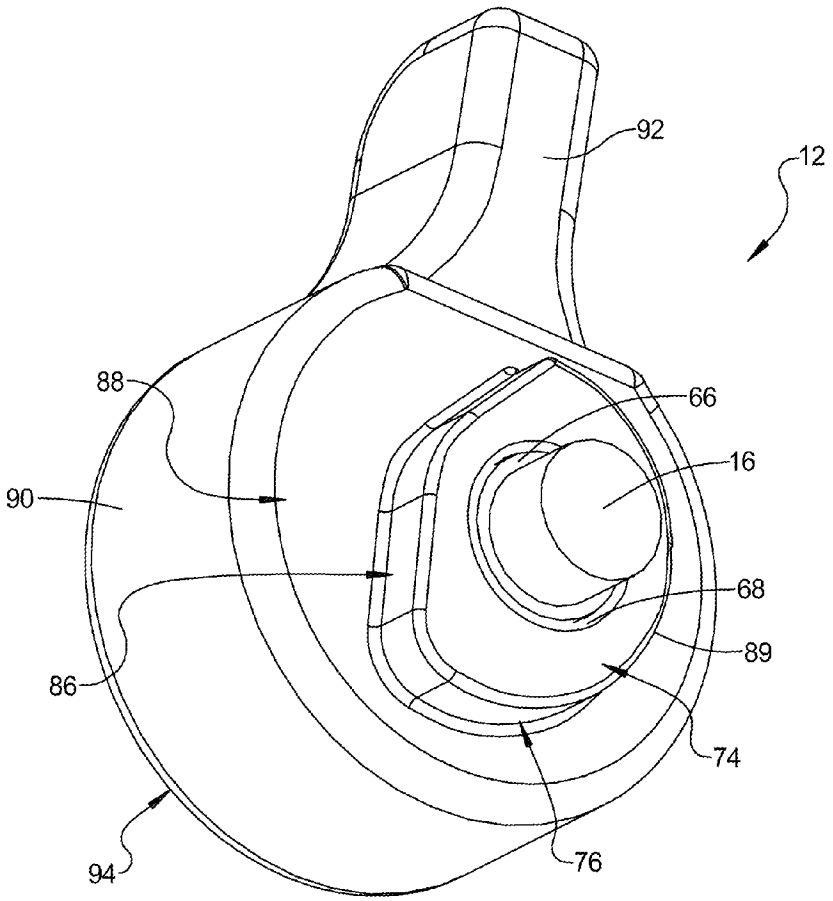
FIG. 6 is a front right perspective view of the cam member of FIGS. 4 and 5.

Referring to FIG. 6 and again to FIGS. 1-5, as previously noted, the cam member 12 can be made of a polymeric material using an injection molding process, and the cam mount shaft 16 is rotatably mounted through cam member 12. According to several aspects, the first cam end face 74 is oriented parallel with respect to a cam support face 88. The cam surface 76 is therefore also oriented substantially transverse with respect to cam support face 88 such that first cam end face 74 is raised with respect to cam support face 88 thereby defining a raised cam body 89. The sleeve liner 68, which supports the bearing sleeve 66, extends entirely through a body column 90 and the cam body 89 of cam member 12 and is oriented transverse with respect to cam support face 88. Extending radially outward from the body column 90 is a cam arm 92 also integrally molded from the polymeric material of body column 90. The cam arm 92 provides manual contact for rotation of the cam member 12. At an opposite facing end of body column 90 with respect to cam support face 88, is a column end face 94, which is oriented substantially parallel with respect to cam support face 88.

Figure 7:
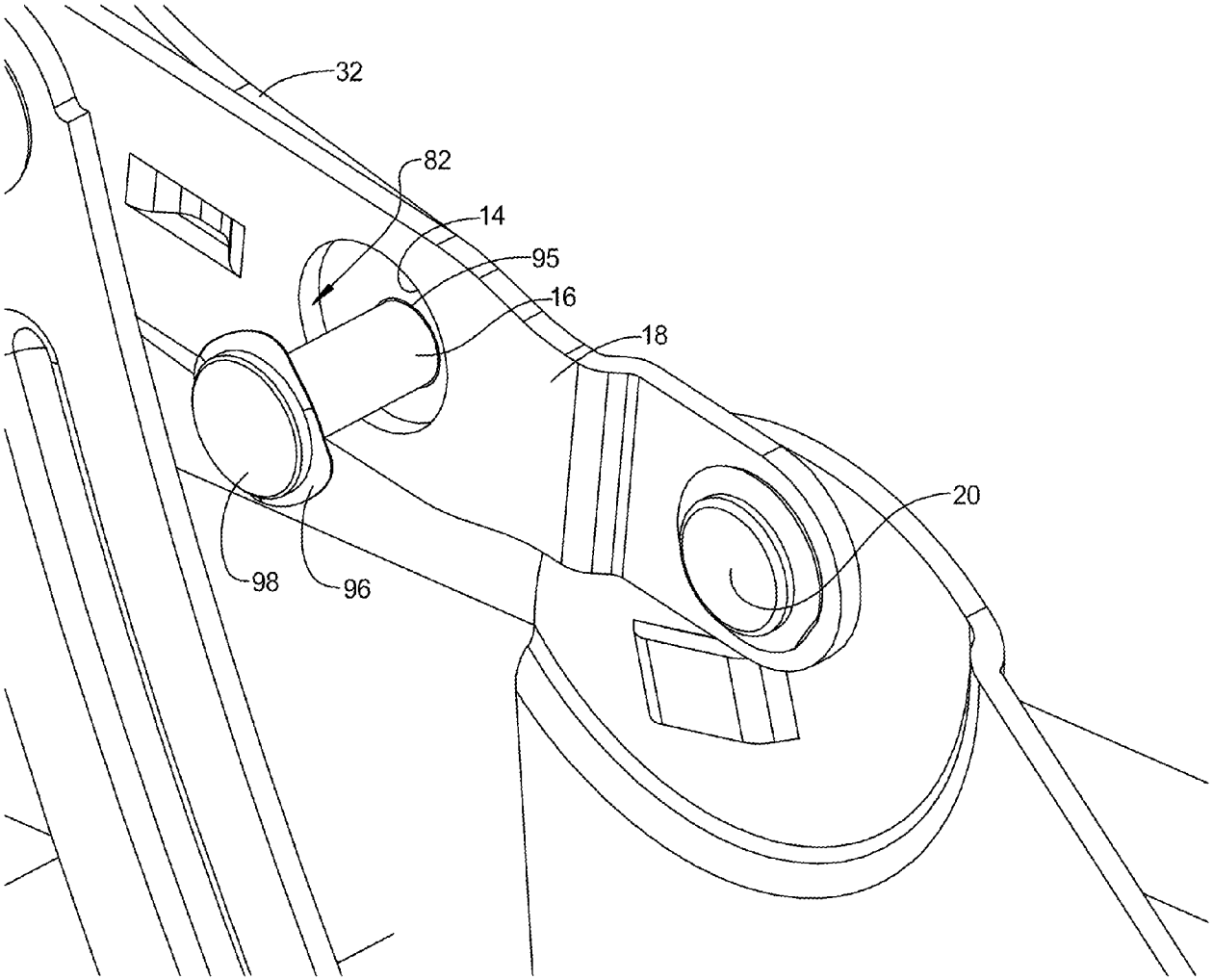
FIG. 7 is a front right perspective view of an exemplary seatback member cam adjustment system having the cam member removed for clarity.

Referring to FIG. 7 and again to FIGS. 1-6, the cam mount shaft 16 is shown in its installed position within bore 14 of seat link 18, and rotatably received within and supported by a second bore 95 of leg 32 of the leg portion 32 of seatback link 28. Second bore 95 is sized to slidably receive and then rotatably support cam mount shaft 16. Second bore 95 is smaller than first bore 14, and therefore has a smaller diameter than a diameter of first bore 14. For clarity, cam member 12 is not shown in FIG. 7. A washer 96 fixed to a head 98 at an end of the cam mount shaft 16 is provided to physically contact the column end face 94 cam member 12 (shown in detail in FIG. 8). The leg 32 of seatback link 28 will be displaced with respect to seat link 18 by rotation of cam member 12 causing rotation of leg 32 with respect to axis of rotation 33 of second rotational fastener 24 to provide for the adjustment capability of the present disclosure. The seatback link 28 rotates as the cam member 12 is rotated causing displacement of the cam surface 76 with respect to bore inner wall 82 of bore 14. Seatback link 28 rotation is with respect to the central axis of rotation 33 defined through second rotational fastener 24.

Referring to FIG. 8 and again to FIGS. 1-7, arm 92 of cam member 12 is shown in its furthest rearward rotated position, which provides the rearward located position of the seatback members as shown in reference to FIG. 2. The column end face 94 of cam member 12 is positioned in direct rotatable contact with respect to a planar face 100 of seat link 18. The washer 96 and head 98 of cam mount shaft 16 (not clearly visible in this view) contact the cam support face 88 while an opposite or free end of cam mount shaft 16 is peened or otherwise fixed such that the cam mount shaft 16 is rotatably coupled to the leg 32 of seatback link 28. From this position, the cam arm 92 can be rotated in the arm arc of rotation "C" to forwardly move or adjust the position of the associated seatback member. The seatback member is substantially infinitely adjustable within the approximate 4 degrees of rotation range provided by cam member 12. It is noted the position of cam arm 92, after it is rotated, remains at the rotated position providing for the amount of adjustment desired, and thereafter remains in that rotated position due to friction between the cam surface 76 and the bore inner wall 82 of bore 14 (not visible in FIG. 8).

Figure 8:
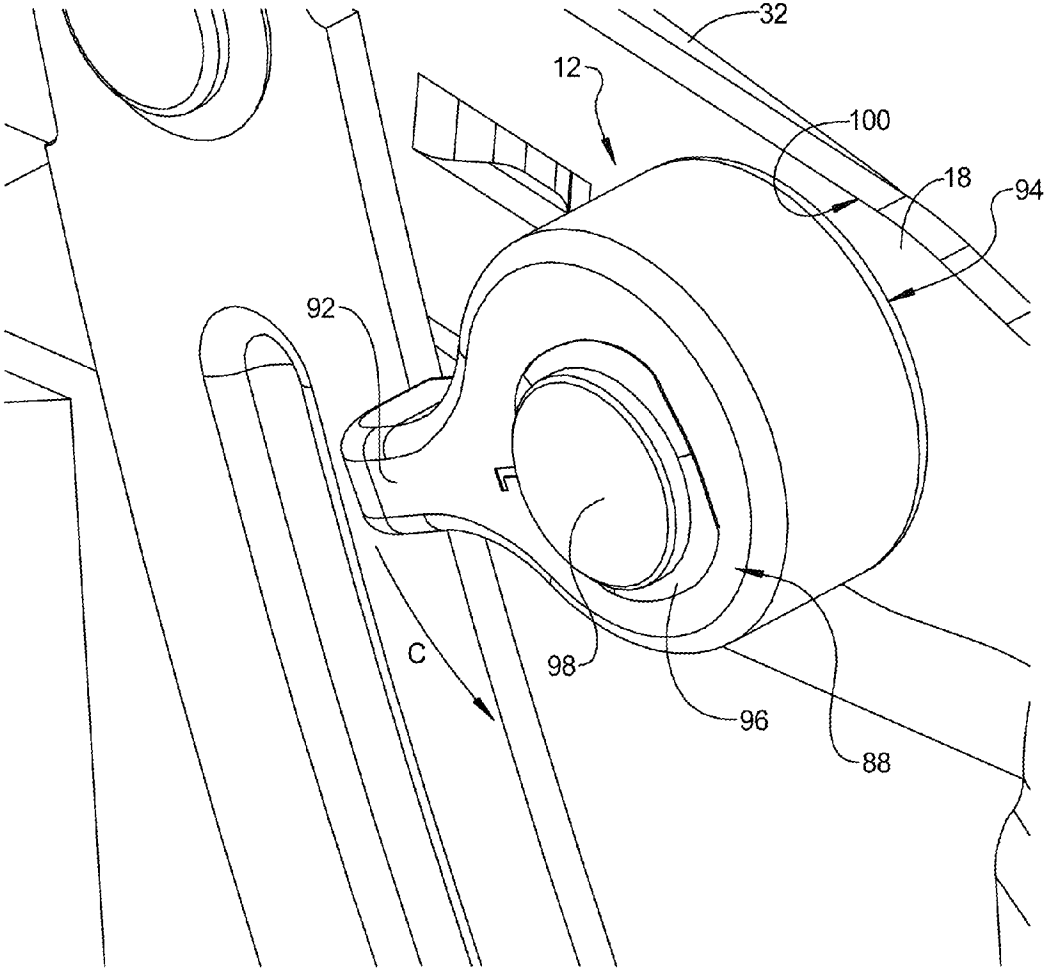
FIG. 8 is a front right perspective view of the cam member oppositely facing with respect to FIG. 4 at the cam member first adjustment position.
Figure 9:
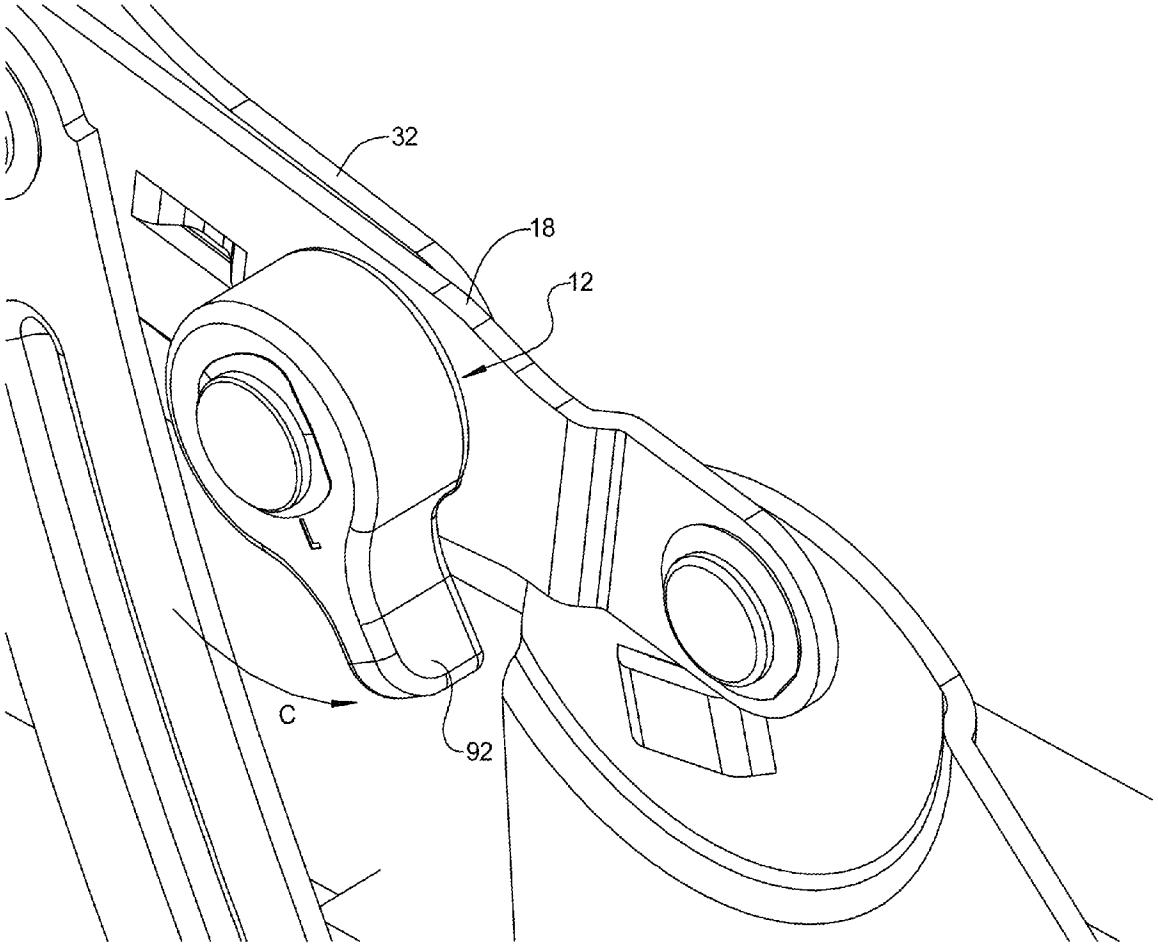
FIG. 9 is a front right perspective view modified from FIG. 8 to show the cam member rotated to the second adjustment position.

Referring to FIG. 9 and again to FIG. 8, cam arm 92 and cam member 12 are shown after full rotation with respect to the arm arc of rotation "C". At this position of cam arm 92, the seatback link 28 is fully rotated with respect to the approximate 4 degrees of adjustment rotation provided by cam member 12 (see FIGS. 1 and 3).

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A seatback member cam adjustment system, comprising:

a seat link having a first bore;

a seatback link rotatably connected using a rotational fastener to the seat link, the seatback link having:

an arm portion; and a leg portion integrally formed with the arm portion, the leg portion fixedly oriented at an angle with respect to the arm portion, the leg portion including a second bore smaller than the first bore;

a cam member having a cam body positioned in the first bore of the seat link;

a cam surface of the cam body having oppositely facing first and second cam contact points both in direct contact with a bore inner wall of the first bore; and a cam mount shaft rotatably supported in the cam member including the cam body and extending through the second bore of the seatback link such that the cam mount shaft is rotatably supported in the second bore, rotation of the cam member displacing the first and second cam contact points along the bore inner wall of the first bore thereby changing an orientation angle of the arm portion with respect to the seat link and changing an orientation angle of a furniture member seatback member.

2. The seatback member cam adjustment system of claim 1, wherein the cam member includes a body column having the cam body raised with respect to a cam support face of the body column, the cam body having the cam surface radially outwardly facing from the cam body.

3. The seatback member cam adjustment system of claim 2, wherein the cam support face is positioned in direct contact with the seat link when the cam body is received in the first bore.

4. The seatback member cam adjustment system of claim 2, further including:

a body column sleeve created in the cam body; and a bearing positioned in the body column sleeve rotatably supporting the cam mount shaft within the cam member.

5. The seatback member cam adjustment system of claim 1, further including a furniture member frame section having the seatback member rotatably connected to the furniture member frame section using the seatback link.

6. The seatback member cam adjustment system of claim 1, further including a coupling member fixed to the seatback member, the arm portion of the seatback link coupled to the coupling member, the leg portion of the seatback link connected by the rotational fastener to the seat link and to an arcuate link.

7. The seatback member cam adjustment system of claim 1, further including a portion of the cam surface between the first and second cam contact points spaced away from the bore inner wall thereby defining a continuous gap.

8. The seatback member cam adjustment system of claim 1, wherein the cam member rotates between a first position and a second position, and wherein a longitudinal axis of the cam mount shaft is offset from a central axis of the first bore at each of the first and second positions.

9. A seatback member cam adjustment system, comprising:

a seat link having a first bore;

a seatback link rotatably connected using a rotational fastener to the seat link, the seatback link having a leg portion, the leg portion including a second bore smaller than the first bore;

a cam member having a cam body positioned in the first bore of the seat link;

a cam surface of the cam body having oppositely facing first and second cam contact points both in direct contact with a bore inner wall of the first bore and a portion of the cam surface between the first and second cam contact points spaced away from the bore inner wall; and a cam mount shaft rotatable about a longitudinal axis of the cam mount shaft in the cam body and extending through the second bore of the seatback link such that the cam member is rotatably supported by the cam mount shaft, rotation of the cam member repositioning the first and second contact points along the bore inner wall of the first bore thereby changing an orientation angle of the seatback link with respect to the seat link, wherein the cam member rotates between a first position and a second position, and wherein a longitudinal axis of the cam mount shaft is offset from a central axis of the first bore at each of the first and second positions.

10. The seatback member cam adjustment system of claim 9, further including an arm portion integrally connected to the leg portion, the arm portion oriented at a fixed angle with respect to the leg portion.

11. The seatback member cam adjustment system of claim 10, wherein the arm portion is coupled to a seatback member such that adjusting the orientation angle of the seatback link adjusts an orientation angle of the seatback member.

12. The seatback member cam adjustment system of claim 9, wherein the orientation angle varies between 0 and 4 degrees.

13. The seatback member cam adjustment system of claim 9, wherein the cam member includes a first cam end face oriented parallel with respect to a cam support face, the cam surface also oriented substantially perpendicular with respect to the cam support face such that the first cam end face is raised relative to the cam support face.

14. The seatback member cam adjustment system of claim 13, further including a sleeve liner of the cam member rotatably supporting a bearing sleeve, the bearing sleeve extending entirely through a body column and the cam body and rotatably supporting the cam mount shaft.

15. The seatback member cam adjustment system of claim 14, wherein the cam body is oriented perpendicular with respect to the cam support face, and the cam member includes a cam arm extending radially outward from the body column providing for manual contact for rotation of the cam member.

16. A furniture member including a first seatback member and a seatback member cam adjustment system, the seatback member cam adjustment system comprising:

a seat link having a first bore;

a seatback link rotatably connected using a rotational fastener to the seat link, the seatback link having:

an arm portion; and a leg portion integrally formed with the arm portion, the leg portion fixedly oriented at an angle with respect to the arm portion, the leg portion including a second bore smaller than the first bore;

a coupling member fixed to the first seatback member, the arm portion of the seatback link coupled to the coupling member, the leg portion of the seatback link connected by the rotational fastener to the seat link and further to an arcuate link;

a cam member having a cam body positioned in the first bore of the seat link;

a cam surface of the cam body having oppositely facing first and second cam contact points both in direct contact with a bore inner wall of the second bore; and a cam mount shaft rotatably supported in the cam body and extending through the second bore of the seatback link such that the cam mount shaft is rotatably supported in the second bore, rotation of the cam member changing an orientation angle of the arm portion with respect to the seat link and thereby adjusting an orientation angle of the first seatback member.

17. The furniture member of claim 16, further including at least a second seatback member each of the first and the second seatback members having at least one of the seatback member cam adjustment systems installed therein, a seatback rear edge of the first seatback member and a seatback rear edge of the second seatback member aligned together defining a common reference line by selective operation of one or both of the seatback member cam adjustment systems.

18. The furniture member of claim 16, further including another seatback member cam adjustment system, wherein both of the seatback member cam adjustment systems are attached to the first seatback member and are used in conjunction to rotate the first seatback member.

19. The furniture member of claim 16, wherein the seatback member cam adjustment system includes an extended portion of each of the first and second cam contact points preventing the cam member from displacing with respect to a bore center axis of the first bore except for axial rotation of the cam member with respect to the bore center axis.

20. The furniture member of claim 19, wherein the first and second cam contact points extend to an opposite side of a reference line extending through the bore center axis with respect to the cam surface.

* * * * *